US012209850B1

(12) United States Patent
Xiao

(10) Patent No.: US 12,209,850 B1
(45) Date of Patent: Jan. 28, 2025

(54) DUMMY AMMO AND USE METHOD THEREOF

(71) Applicant: Ningbo Jiuli CNC Machinery Co., Ltd, Zhejiang (CN)

(72) Inventor: Xin'an Xiao, Zhejiang (CN)

( * ) Notice: Subject to any disclaimer, the term of this patent is extended or adjusted under 35 U.S.C. 154(b) by 0 days.

(21) Appl. No.: 18/643,478

(22) Filed: Apr. 23, 2024

(51) Int. Cl.
*F42B 8/08* (2006.01)
*F41A 17/44* (2006.01)

(52) U.S. Cl.
CPC ..... *F42B 8/08* (2013.01)

(58) Field of Classification Search
CPC ..... F42B 8/00; F42B 8/02; F42B 8/08; F41A 17/44
See application file for complete search history.

(56) References Cited

U.S. PATENT DOCUMENTS 1,256,255 A * 2/1918 Porter ..... F42B 5/02 73/167
1,347,659 A * 7/1920 Reardon ..... F42B 8/08 124/28
2,342,549 A * 2/1944 Le Gore ..... F42B 8/08 102/498
2,405,308 A * 8/1946 Jack ..... F42B 8/02 73/167
2,836,918 A * 6/1958 Pula ..... F41A 17/44 42/70.11
2,882,821 A * 4/1959 Benson ..... F42B 8/08 102/444
3,027,840 A * 4/1962 Hannas ..... F42B 8/08 102/444
3,156,373 A * 11/1964 Willis ..... F41A 17/44 220/237
3,208,176 A * 9/1965 Giles ..... F41A 17/44 42/70.11
3,245,348 A * 4/1966 Lahr ..... F41C 3/00 102/441
3,848,350 A * 11/1974 Seminiano ..... F42B 8/08 102/444
4,224,753 A * 9/1980 Bielman ..... F41A 17/44 42/70.11
4,391,199 A * 7/1983 Morin ..... F42B 8/02 102/374
4,450,769 A * 5/1984 Moser ..... F42B 8/08 102/444
5,239,767 A * 8/1993 Briley, Jr. ..... F41A 17/44 42/70.11
5,259,319 A * 11/1993 Dravecky ..... F42B 8/10 102/447

(Continued)

*Primary Examiner* — Derrick R Morgan
(74) *Attorney, Agent, or Firm* — Hawaii Patent Services; Nathaniel K. Fedde; Kenton N. Fedde

(57) ABSTRACT

A dummy ammo comprises a counterweight component and a contour component, wherein the counterweight component comprises at least one counterweight block, and the contour component comprises at least one cartridge shell; the cartridge shell is provided with at least one inner wall, and the inner wall defines at least one cavity; the counterweight block is arranged in the cavity; when the counterweight block is fixed, the dummy ammo has a weight distribution close to that of a live ammo, so that the problem of being difficult to eject during training can be solved, and the experience is better when being used.

17 Claims, 14 Drawing Sheets

(56) References Cited

U.S. PATENT DOCUMENTS

| | | | | | |
|---|---|---|---|---|---|
| 5,315,778 | A * | 5/1994 | Wolford | F41A 17/44 | 42/70.11 |
| 5,363,769 | A * | 11/1994 | Bellak | F42B 7/02 | 42/105 |
| 6,041,536 | A * | 3/2000 | Samuels | F41A 17/44 | 42/70.11 |
| 6,189,454 | B1 * | 2/2001 | Hunt | F42B 12/74 | 102/444 |
| 6,305,290 | B1 * | 10/2001 | Stimmell | F42B 8/08 | 102/444 |
| 6,698,126 | B2 * | 3/2004 | Worley | F41A 17/44 | 42/70.11 |
| 10,337,844 | B1 * | 7/2019 | Wall | F42B 8/08 | |
| 2001/0007228 | A1 * | 7/2001 | Proffitt | F42B 8/08 | 102/444 |
| 2002/0059746 | A1 * | 5/2002 | Ross | F41A 17/44 | 42/70.11 |
| 2002/0170222 | A1 * | 11/2002 | Alanko | F41A 17/44 | 42/70.11 |
| 2007/0137085 | A1 * | 6/2007 | Aske | F42B 5/02 | 42/70.11 |
| 2008/0086927 | A1 * | 4/2008 | Wajdic | F41A 17/44 | 42/70.11 |
| 2012/0180688 | A1 * | 7/2012 | Padgett | F42B 5/30 | 102/466 |
| 2020/0080803 | A1 * | 3/2020 | Peterson | F41A 3/54 | |
| 2020/0096282 | A1 * | 3/2020 | Taylor | F42B 5/24 | |
| 2020/0173747 | A1 * | 6/2020 | Thomas | F41A 17/44 | |
| 2021/0055070 | A1 * | 2/2021 | Quaintance | F41A 17/44 | |
| 2023/0228545 | A1 * | 7/2023 | Wilkes | F41A 33/00 | 102/444 |

* cited by examiner

DUMMY AMMO AND USE METHOD THEREOF

TECHNICAL FIELD

The present invention relates to the field of training ammos, in particular to a dummy ammo and a use method thereof.

BACKGROUND

Training ammo is a kind of ammunition that can't be filled with gunpowder or explosives. It is usually used in the training of ammunition loading and unloading, shooting feel and muscle memory to simulate the action effect needed in actual shooting. The training ammo not only has the appearance and weight close to the live ammo, but also does not cause explosion or injury when it is launched, therefore it has high safety, which can help users to be familiar with the use method and shooting skills of weapons and improve their actual combat ability.

A patent document with a publication number of U.S. Pat. No. 6,223,657B1 discloses a simulated ammunition device, which comprises a first part with a longitudinal axis and a blind hole arranged therein at a position coaxial with the longitudinal axis of the first part; the second part has a longitudinal axis, a generally cylindrical head including a circumferential edge and a stud extending coaxially with the longitudinal axis of the second part, and the stud is received by the blind hole of the first part; and a structure for retaining the stud in the blind hole.

This simulated ammunition has simple structure and firm connection, but the two parts of this simulated ammunition are made of different materials, the first part is made of plastic material, and the second part is made of metal material, which makes the center of gravity of the simulated ammunition backward, so it will have a different feel from the live ammo, which will bring users a bad use experience, and at the same time, it may be difficult to eject smoothly during training and use.

Therefore, it is necessary to propose a new type of dummy ammo structure, which can not only simulate the weight and shape of a dummy ammo, but also simulate the weight distribution of a dummy ammo, and bring users a better use experience.

SUMMARY

The present invention provides a dummy ammo, which includes at least one counterweight component and at least one contour component, wherein the contour component is a rotating body, the contour component has at least one longitudinal axis, and the contour component defines at least one front end and at least one rear end; and the contour component comprises at least one cartridge shell, and the counterweight component comprises at least one counterweight block, wherein the cartridge shell is provided with at least one inner wall; the inner wall defines at least one cavity, and the counterweight block is fixed in the cavity, and the cartridge shell is provided with at least one counterweight opening, and the counterweight opening is close to the front end; and when the counterweight component is fixed, a center of gravity of the counterweight component is close to the counterweight opening and far away from the rear end in a direction parallel to the longitudinal axis.

The present invention further provides a method for assembling a dummy ammo, comprising providing at least one counterweight component and at least one contour component, wherein the contour component is a rotating body, the contour component has at least one longitudinal axis, and the contour component defines at least one front end and at least one rear end; the contour component comprises at least one cartridge shell, and the counterweight component comprises at least one counterweight block, wherein the cartridge shell is provided with at least one inner wall, and the inner wall defines at least one cavity; the cartridge shell is provided with at least one counterweight opening, which is close to the front end; and the method for assemble a dummy ammo comprises the follow steps:

putting the counterweight component into the cavity from the counterweight opening; and allowing the counterweight component and the contour component to be fixedly connected.

The present invention further provides a method for assembling a dummy ammo, comprising providing at least one connector, at least one base, at least one counterweight block and at least one cartridge shell, wherein the cartridge shell is provided with at least one inner wall which defines at least one cavity, the cartridge shell is provided with at least one counterweight opening, and the base is provided with at least one joint cavity, and the counterweight block has a density different from that of the cartridge shell; and the method for assemble a dummy ammo comprises the follow steps:

connecting the connector with the counterweight block;

putting the counterweight block into the cavity from the counterweight opening;

connecting the cartridge shell with the base; and allowing the connector to be fixedly connected with the base through the joint cavity.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
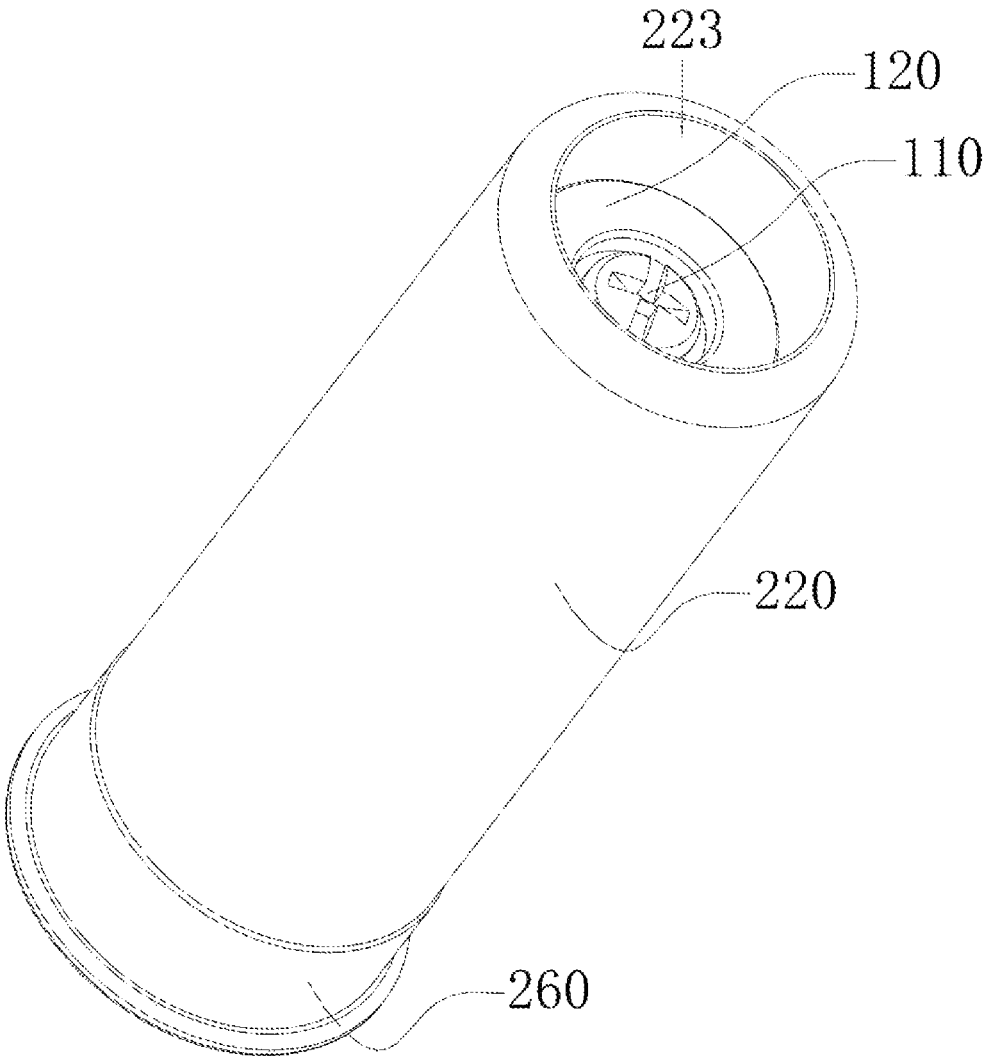
FIG. 1 is a schematic perspective view of a dummy ammo.

In the figures: Connector (110); Counterweight block (120); Counterweight connecting part (122); Bushing (140); Cartridge shell (220); Inner wall (2201); Basic positioning part (2203); Reinforced positioning part (2206); Cartridge shell receiving part (2210); Cartridge shell receiving cavity (2215); Counterweight opening (223); Counterweight accommodating cavity (225); Pressing block (240); Base (260); Top surface (2605); Joint part (2610); Joint cavity (2612); Bottom surface (2615); Primer cavity (270); Receiving sidewall (275); Base counterweight (280); Shock absorber (300); Distinguishing part (330).

DESCRIPTION OF EMBODIMENTS

In the following, the technical scheme in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

Figure 2:
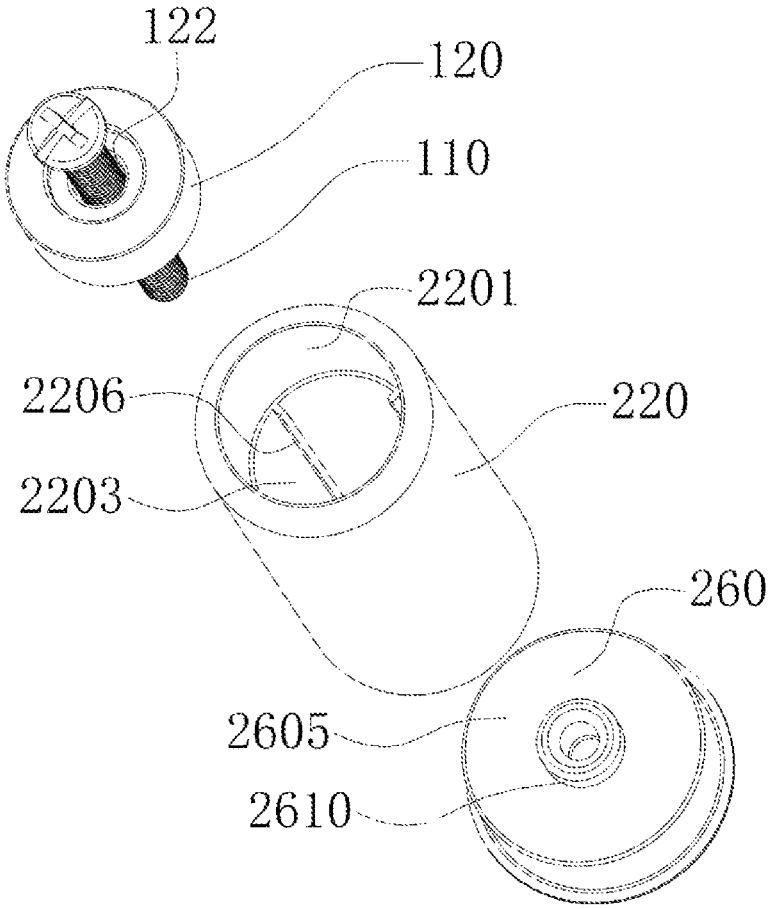
FIG. 2 is an explosion view of the dummy ammo as viewed from the upper side.

As shown in FIG. 1 and FIG. 2, the present invention provides a dummy ammo, which includes a contour component and a counterweight component, wherein the contour component comprises a cartridge shell 220 and a base 260; the contour component has approximately the same outline as the live ammo; and the counterweight component comprises a counterweight block 120 and a connector 110.

The contour component is a rotating body, has at least one longitudinal axis, defines at least one front end and at least one rear end, and the base 260 is close to the rear end.

The cartridge shell 220 is provided with a counterweight opening 223 and an inner wall 2201. The cartridge shell 220 has a generally cylindrical external structure. The counterweight opening 223 is close to the front end, and the counterweight opening 223 and the inner wall 2201 define a cavity, which is arranged inside the cartridge shell 220, and the counterweight block 120 is arranged in the cavity.

The counterweight block 120 has a counterweight connecting part 122, and a joint part 2610 is arranged on the base 260.

At least one baffle ring is arranged at the rear end of the contour component, and the baffle ring has an outer diameter larger than that of the cartridge shell 220, so as to better simulate the shape of live ammo and smoothly realize the function of loading ammunition.

The inner wall 2201 is provided with a basic positioning part 2203, which protrudes from the inner wall 2201 and tends to approach the central axis of the cartridge shell 220.

As shown in FIGS. 1 and 2, in this embodiment, the basic positioning part 2203 has a cylindrical structure, the diameter and height of the basic positioning part 2203 are smaller than those of the inner wall 2201, and the outer diameter of the counterweight block 120 is larger than that of the basic positioning part 2203 but smaller than that of the inner wall 2201, therefore the basic positioning part 2203 can limit the position of the counterweight block 120 in the cartridge shell 220. The connector 110 has a head, and the outer diameter of the head is larger than the inner diameter of the counterweight connecting part 122. When the connector 110 is closely connected with the joint part 2610, the counterweight block 120 can be limited to a specific position in the cartridge shell 220, so that the dummy ammo can simulate the distribution of the center of gravity of the live ammo, and the problem that the dummy ammo is not easy to pop up when the center of gravity is low is solved, and the center of gravity does not change when it is used.

The basic positioning part 2203 is also provided with a reinforced positioning part 2206, which protrudes from the basic positioning part 2203 and tends to approach the central axis of the cartridge shell 220. In this embodiment, the reinforced positioning part 2206 has a slender rectangular parallelepiped shape and the length is consistent with the basic positioning part 2203.

In this embodiment, the number of reinforcing positioning parts 2206 is four, and in other embodiments, it can be other numbers that meet the requirements of functions, such as single, two, and other shapes and structures, such as triangles, isosceles trapezoid, and the like.

In this embodiment, the counterweight block 120 has a cylindrical cross-sectional shape, and in other embodiments, it can also have other shapes such as triangle and square, and there is a structure or cavity inside the cartridge shell 220 that can match the shape of the counterweight block 120.

The reinforcing positioning part 2206 can better restrict the movement of the counterweight block 120, but it is not necessary. Therefore, in another embodiment, there may not be the reinforcing positioning part 2206, and the position of the counterweight block 120 can be restricted only by the basic positioning part 2203, which can be a single protrusion arranged on the inner wall 2201, or a circular structure in another embodiment.

In this embodiment, the connector 110 is a bolt, the counterweight connecting part 122 is a through hole arranged in the center of the counterweight block 120, and the counterweight block 120 can move on the connector 110, and the joint part 2610 has a threaded part matched with the bolt. The connector 110 passes through the through hole to connect the counterweight block 120, the cartridge shell 220 and the base 260.

In another embodiment, the counterweight block 120 is fixed on the connector 110, for example, the counterweight block 120 cannot move on the connector 110 by gluing, welding, hot melting, etc. At this time, there is no need to set the basic positioning part 2203.

In another embodiment, the counterweight block 120 and the connector 110 are designed as an integral structure, therefore the head of the connector 110 is large and has a certain weight, which can also ensure the distribution of the center of gravity of the dummy ammo with simulated live ammo, and there is no need to set the basic positioning part 2203.

Figure 3:
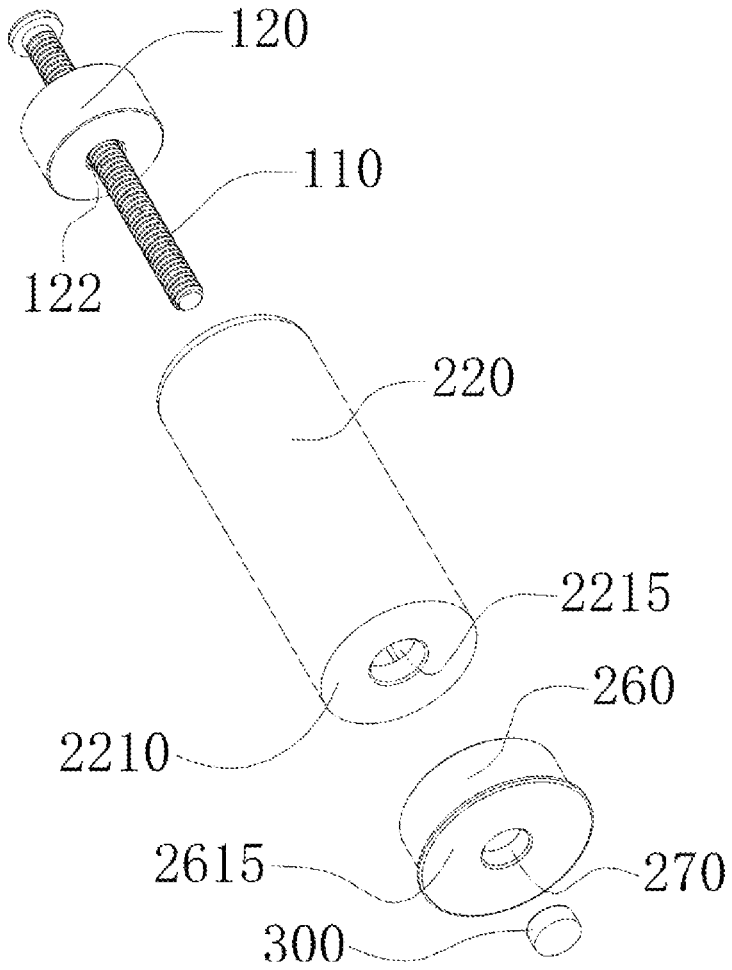
FIG. 3 is an explosion view of the dummy ammo viewed from the side below.

As shown in FIG. 2 and FIG. 3, the cartridge shell 220 is provided with a cartridge shell receiving part 2210, a cartridge shell receiving cavity 2215, a bottom surface 2615 on the base 260 opposite to the top surface 2605, and a primer cavity 270 on the bottom surface 2615. The primer cavity 270 is internally provided with a shock absorber 300, and the shock absorber 300 includes at least a part of materials that can absorb shock.

In this embodiment, the shock absorber 300 is rubber. The shock absorber 300 is a solid structure with a cylindrical appearance and is fixed in the primer cavity 270 by bonding. In other embodiments, the shock absorber 300 can be made of other materials, such as silica gel, clastic synthetic materials and other materials that can meet the use requirements. The main function of the shock absorber 300 is to protect the structure of the firing ammunition of firearms and prolong the service life of firearms.

In other embodiments, the shock absorber 300 can be directly pressed into the primer cavity 270, and the shock absorber 300 can only contain part of the shock absorber material.

Figure 4:
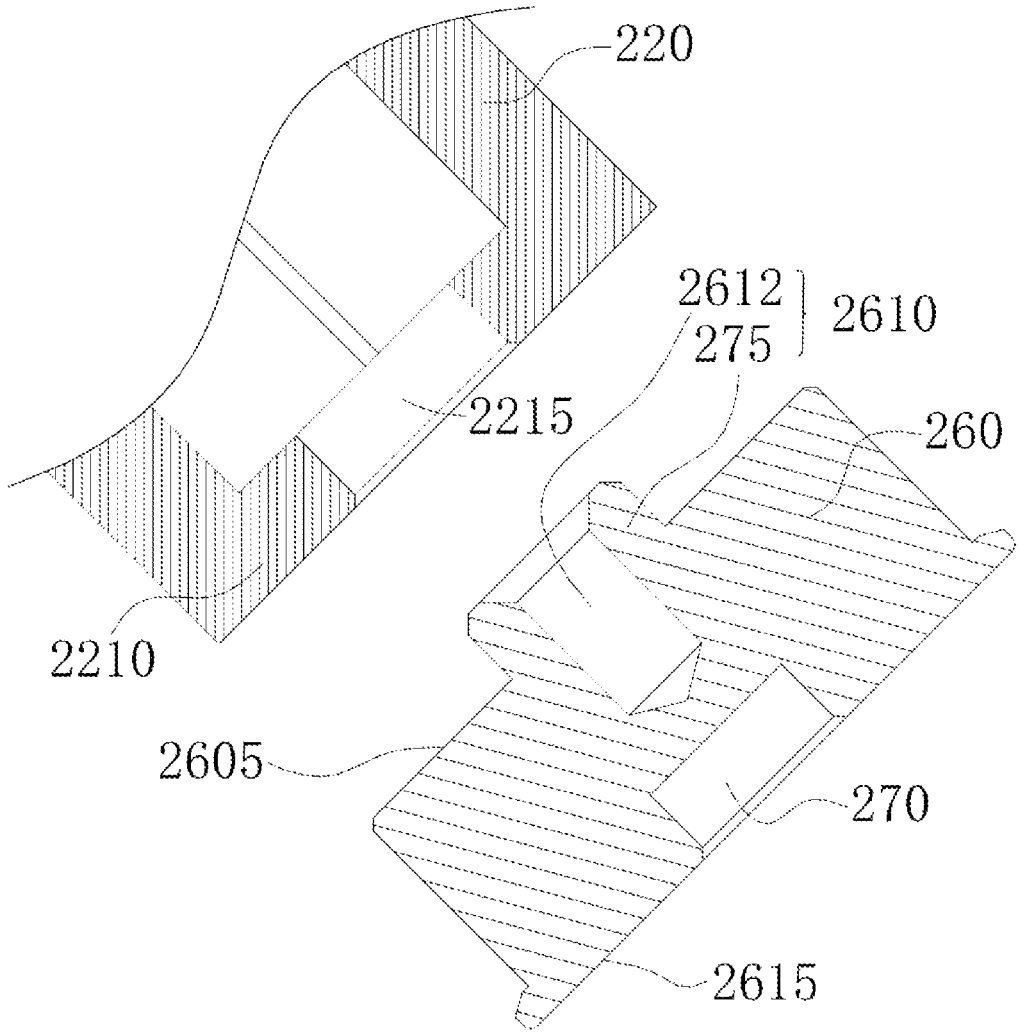
FIG. 4 is a partial sectional view of the connection area between the cartridge shell and the base.

As shown in FIGS. 2 to 4, the joint part 2610 includes a receiving sidewall 275 and a joint cavity 2612. The receiving sidewall 275 protrudes from the top surface 2605 in a direction away from the bottom surface 2615, and the receiving sidewall 275 covers the joint cavity 2612, which has a higher height than the receiving sidewall 275, therefore a part of the joint cavity 2612 exceeds the top surface 2605 in a direction away from the bottom surface 2615, while part thereof is from the top surface 2605 to the direction close to the bottom surface 2615. This arrangement has the advantage of reserving more space and ensuring that the connector 110 can firmly confine the counterweight block 120 in the cartridge shell 220.

In this embodiment, the cartridge receiving part 2210 is concave and the base 260 is convex, and the inner diameter of the cartridge receiving cavity 2215 is larger than the outer diameter of the receiving sidewall 275, so that the cartridge receiving cavity 2215 can accommodate the receiving sidewall 275, and when the base 260 is connected with the cartridge shell 220, the base 260 is partially inserted into the cartridge shell 220, and the base 260 can be better positioned.

In another embodiment, the cartridge shell receiving part 2210 is convex and the base 260 is concave, and the cartridge shell receiving part 2210 is inserted into the base 260.

In other embodiments, the cartridge shell 220 and the base 260 do not adopt a concave-convex structure, and the cartridge shell 220 and the base 260 are in contact with each other through two planes, and the two planes are fixedly connected by gluing, hot melting and the like; the cartridge shell 220 and the base 260 can also be integrally cast or integrally formed without concave-convex structure.

Figure 5:
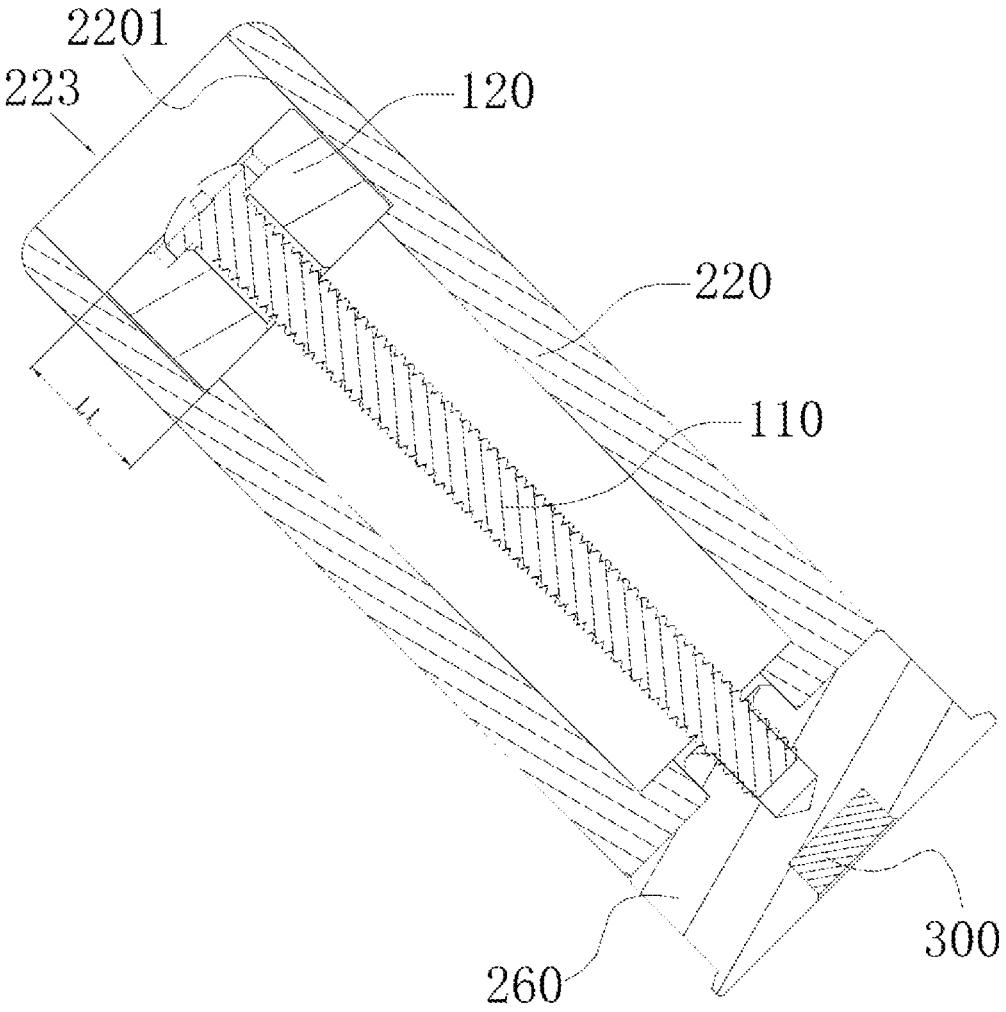
FIG. 5 is a sectional view taken along the longitudinal axis of the first embodiment of the dummy ammo.

As shown in FIG. 2 and FIG. 5, in this embodiment, there is one connector 110, and the connector 110, the counterweight block 120, the base 260, the cartridge shell 220 and the shock absorber have a common axis, but it is not limited to this. In other embodiments, there may be two or more connectors 110 or two or more counterweight blocks 120. At this time, the axes of the connector 110, the counterweight block 120, the base 260, the cartridge shell 220 and the shock absorber are parallel.

Figure 6:
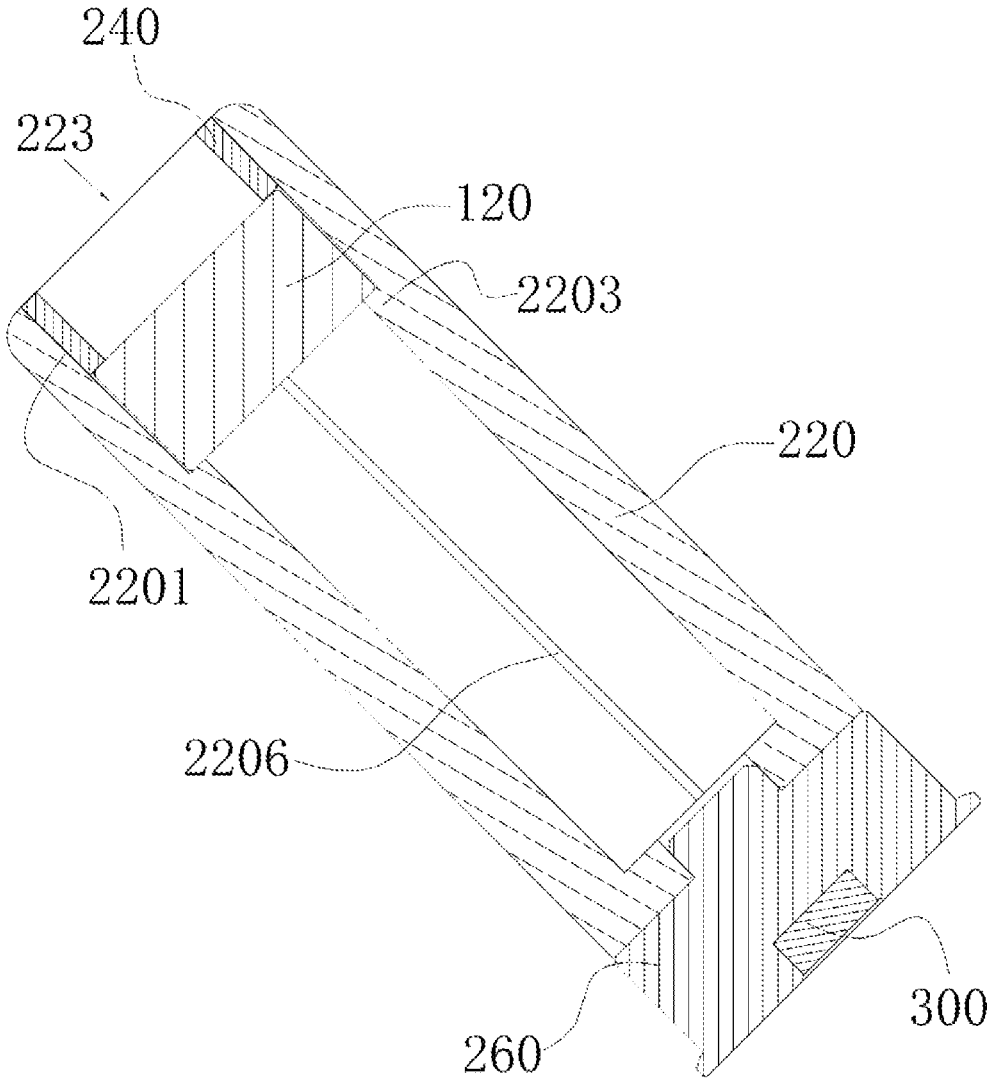
FIG. 6 is a sectional view taken along the longitudinal axis of the second embodiment of the dummy ammo.

As shown in FIG. 6, this is the second embodiment of a dummy ammo, which includes a counterweight block 120, a cartridge shell 220, a base 260, and a pressing block 240. The counterweight block 120 is arranged at one end of the cartridge shell 220 near the counterweight opening 223, and the cartridge shell 220 is provided with a basic positioning part 2203 protruding from the inner wall 2201, so that the position of the counterweight block 120 can be limited. A pressing block 240 is arranged in the cartridge shell 220 in contact with the inner wall 2201. The pressing block 240 can be made of a plastic material with certain elasticity or can be installed with the cartridge shell 220 by interference fit, therefore when installed in the cartridge shell 220, the pressing block 240 can limit the movable position of the counterweight block 120 without other parts for connection.

In this embodiment, there is an interference fit between the base 260 and the cartridge shell 220, and the base 260 is inserted between the cartridge shell 220, therefore the base 260 and the cartridge shell 220 can also be closely connected.

In other embodiments, screw connection, snap connection, hot melt, cold pressing and other fixed connection methods can be adopted between the base 260 and the cartridge shell 220.

In another embodiment, the base 260 and the cartridge shell 220 can also be integrally cast.

Figure 7:
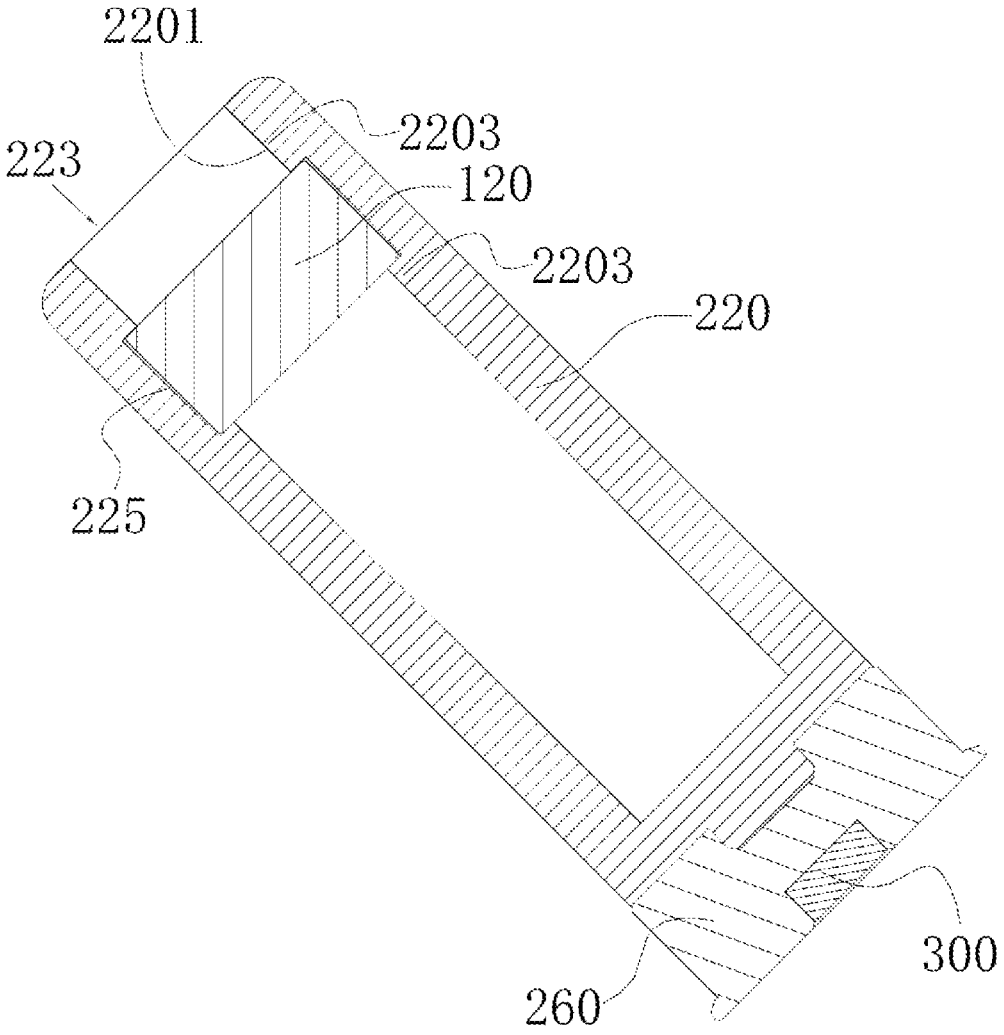
FIG. 7 is a sectional view taken along the longitudinal axis in the third embodiment of the dummy ammo.

As shown in FIG. 7, this is the third embodiment of a dummy ammo, which includes a counterweight block 120, a cartridge shell 220 and a base 260. By adopting an inlay injection molding process between the counterweight block 120 and the cartridge shell 220, the cartridge shell 220 forms a counterweight accommodating cavity 225 around the counterweight block 120 at a position close to the counterweight opening 223. At this time, the cavity of the cartridge shell is no longer a cylindrical structure, but a structure composed of two cylinders with different diameters. Since the counterweight accommodating cavity 225 has a diameter larger than the inner wall 2201 of the cartridge shell 220, the counterweight block 120 can be stably fixed at a specific position in the cartridge shell 220.

Figure 8:
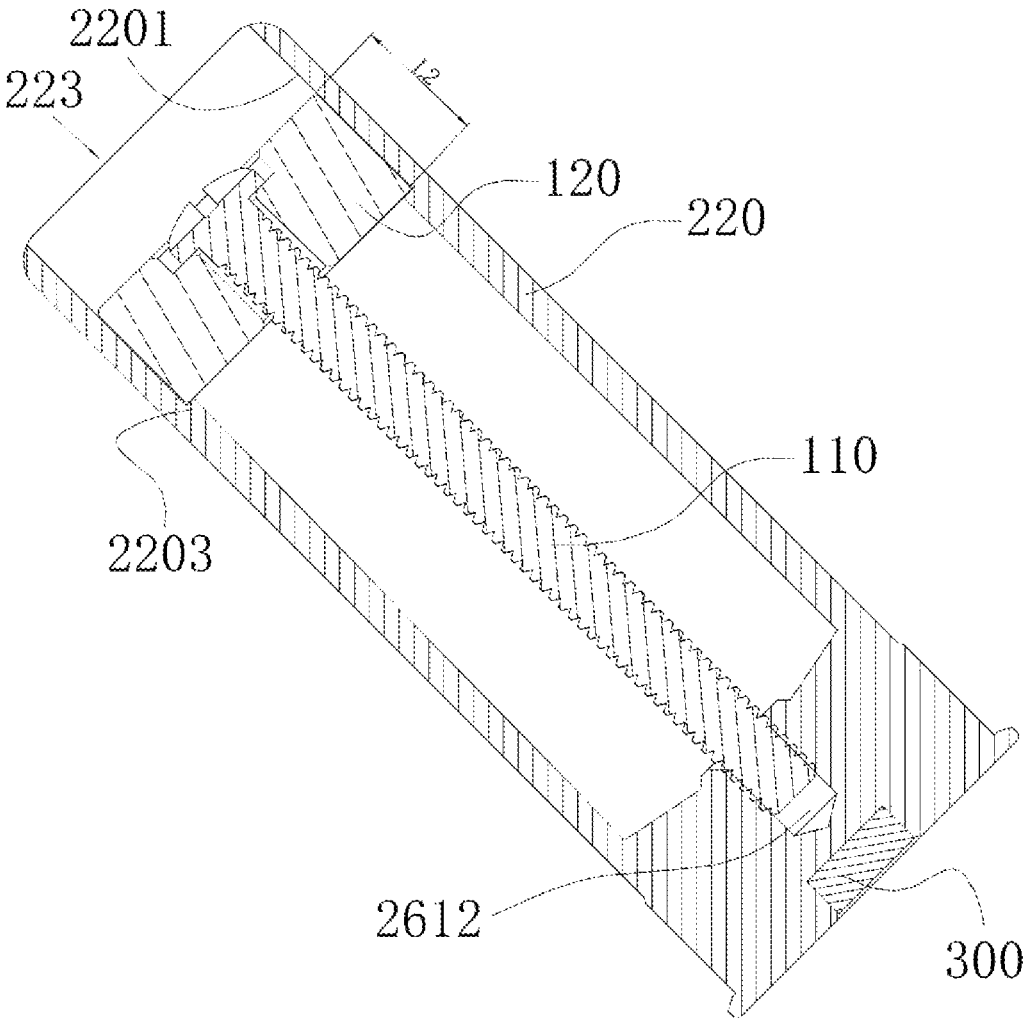
FIG. 8 is a cross-sectional view taken along the longitudinal axis in the fourth embodiment of the dummy ammo.

As shown in FIG. 8, this is the fourth embodiment of the dummy ammo, which includes a counterweight block 120, a cartridge shell 220 and a connector 110. Compared with FIG. 5, the fourth embodiment cancels the base 260, and the cartridge shell 220 is made of metal. Because of its high density, the wall thickness of the cartridge shell 220 needs to be thinned to maintain the original weight and center of gravity distribution. At the same time, in order to adapt to the thinned cartridge shell 220, the diameter of the counterweight block 120 changes and the diameter of the counterweight block 120 becomes larger. In order to maintain the original weight and center of gravity distribution, L2 is smaller than L1.

A joint cavity 2612 is arranged in the cartridge shell 220, and the connector 110 enters the joint cavity 2612, and the counterweight block 120 is fixed at a specific position in the cartridge shell 220 through the basic positioning part 2203.

Figure 9:
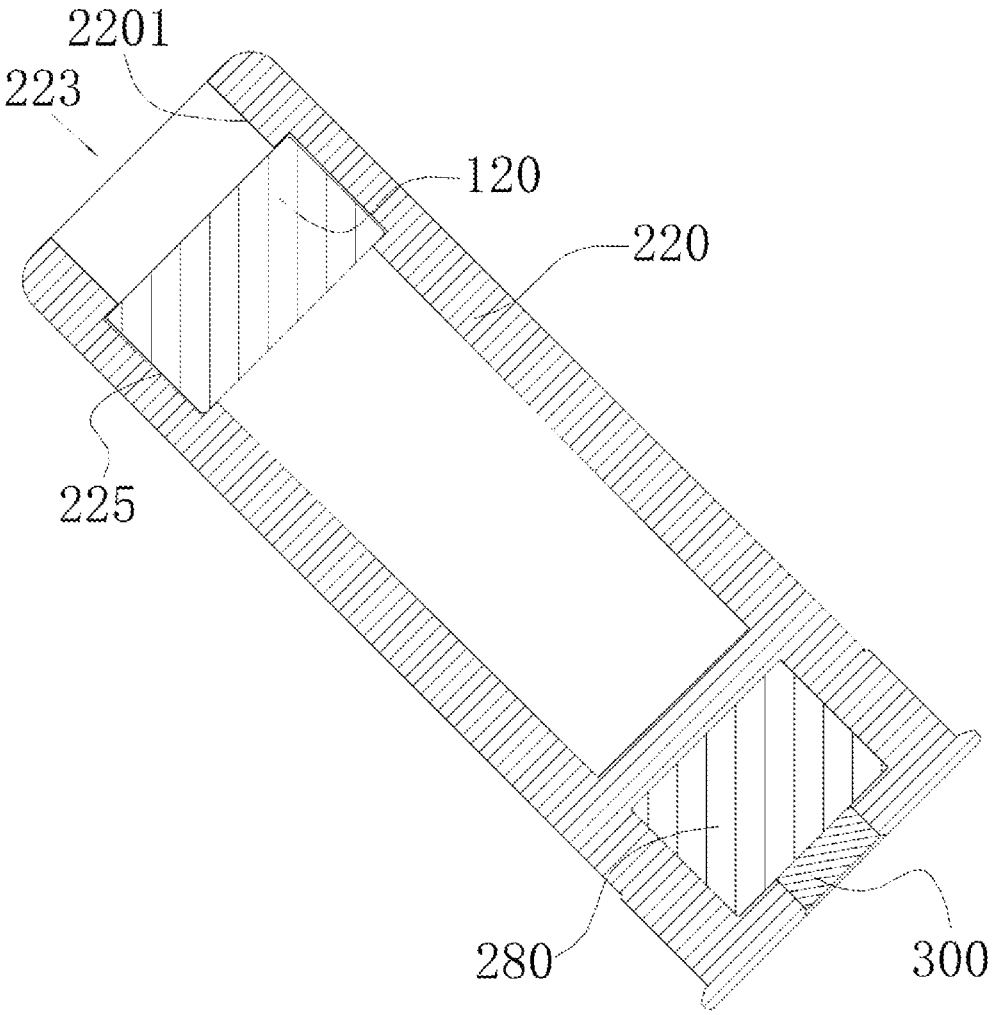
FIG. 9 is a cross-sectional view taken along the longitudinal axis in the fifth embodiment of the dummy ammo.

As shown in FIG. 9, this is the fifth embodiment of a dummy ammo, which includes a counterweight block 120, a cartridge shell 220 and a base counterweight 280. The counterweight block 120 and the base counterweight 280 are all fixed in the cartridge shell 220 by an insert injection molding process. The counterweight block 120 and the base counterweight 280 are made of metal materials, and the cartridge shell 220 is made of plastic or nylon.

Figure 10:
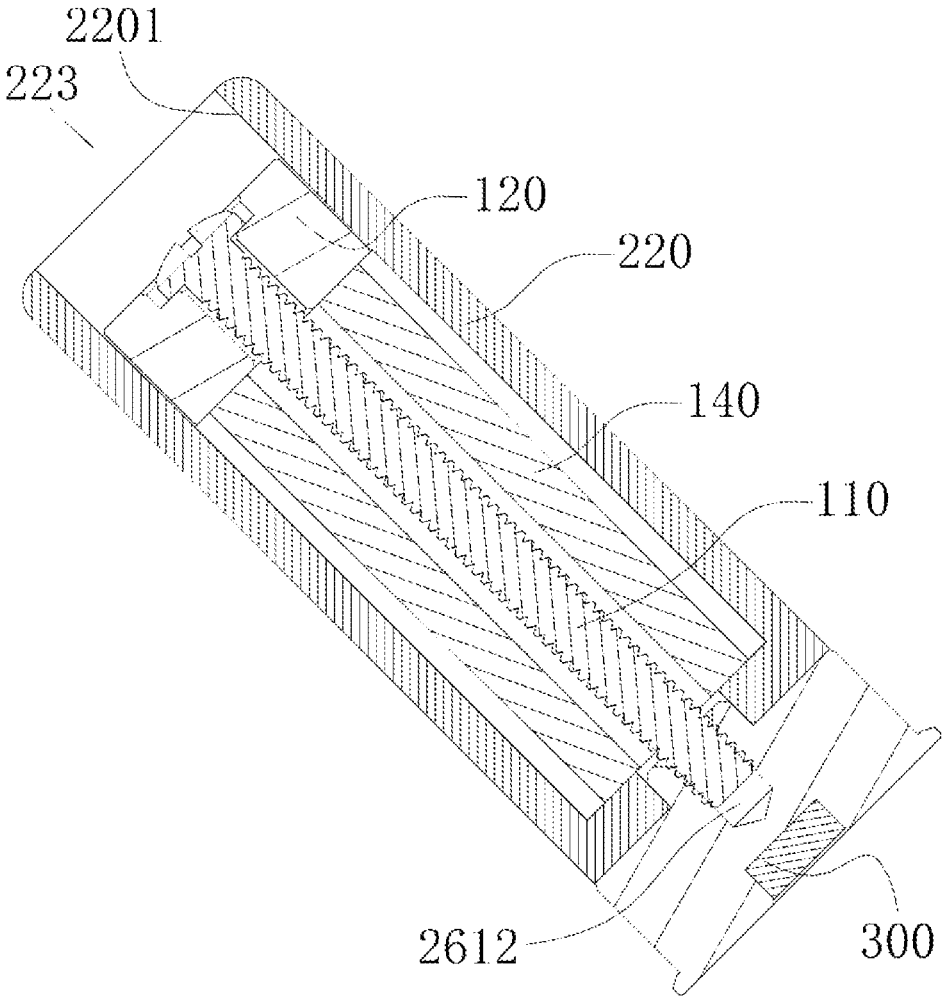
FIG. 10 is a cross-sectional view taken along the longitudinal axis in the sixth embodiment of the dummy ammo.

As shown in FIG. 10, this is the sixth embodiment of a dummy ammo, which includes a counterweight block 120, a cartridge shell 220, a connector 110, a base 260 and a bushing 140.

The bushing 140 has a cylindrical structure. The inner diameter of the bushing 140 is larger than the outer diameter of the connector 110, therefore the connector 110 can be put into the bushing 140. The maximum outer diameter of the bushing 140 is smaller than the inner diameter of the inner wall 2201 of the cartridge shell 220, therefore the bushing 140 can be put into the cartridge shell 220. Both ends of the bushing 140 are in contact with the cartridge shell 220 and the counterweight block 120 respectively, and the base 260 has a joint cavity 2612 for matching the connector 110. When the connector 110 enters the joint part 2612, tightly connect the counterweight block 120, bushing 140, cartridge shell 220, and base 260.

Figure 11:
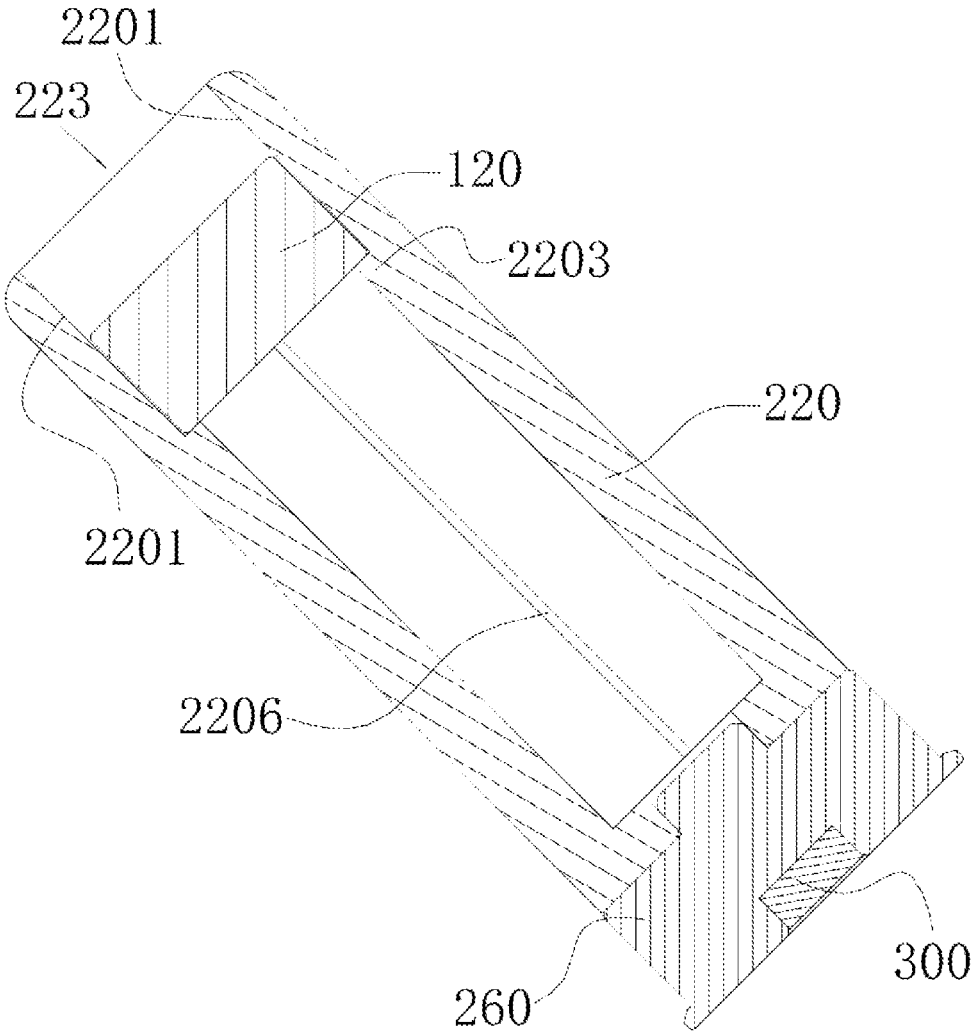
FIG. 11 is a sectional view taken along the longitudinal axis in the seventh embodiment of the dummy ammo.

As shown in FIG. 11, this is the seventh embodiment of a dummy ammo, which includes a counterweight block 120, a cartridge shell 220 and a base 260. After the counterweight block 120 is put into the cartridge shell 220 through the counterweight opening 223, the counterweight block 120 is fixed at a specific position of the cartridge shell 220 by gluing or ultrasonic fixing.

In this embodiment, the inner wall 2201 of the cartridge shell 220 is provided with the basic positioning part 2203, which can limit the position of the counterweight block 120 and make it difficult for the counterweight block 120 to fall off. In another embodiment, the inner wall 2201 is not provided with the basic positioning part 2203, and the counterweight block 120 is fixed at a specific position of the cartridge shell 220 only by gluing or ultrasonic fixation, and the counterweight block 120 is fixed at a specific position of the cartridge shell 220.

Figure 12:
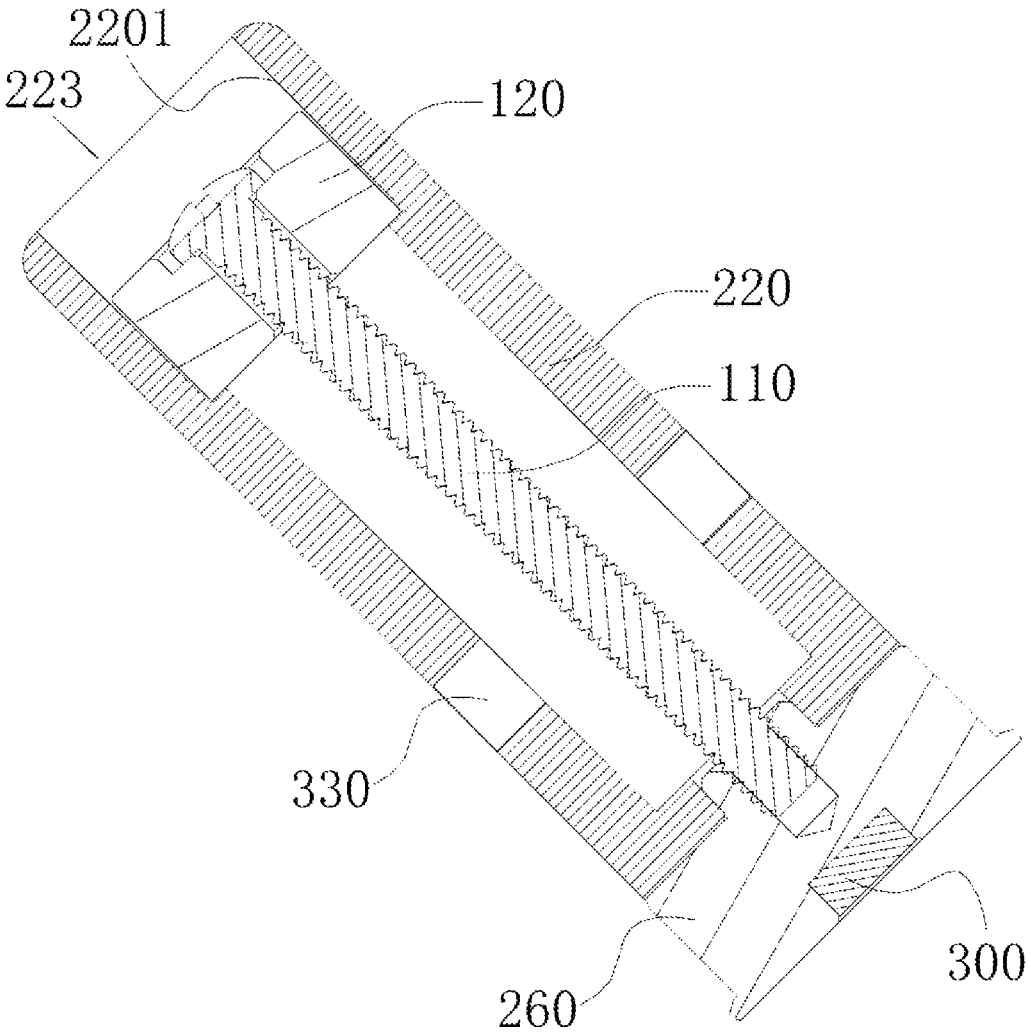
FIG. 12 is a sectional view taken along the longitudinal axis in the eighth embodiment of the dummy ammo.

As shown in FIG. 12, this is the eighth embodiment of the dummy ammo, which includes a counterweight block 120, a cartridge shell 220, a connector and a base 260. It further includes a distinguishing part 330 arranged on the cartridge shell 220.

The function of the distinguishing part 330 is to distinguish live ammo from dummy ammo, so as to avoid confusing the two kinds of ammunition in actual use. In this embodiment, the distinguishing part 330 is a circular opening arranged in the cartridge shell 220, which runs through the cartridge shell 220. In other embodiments, the distinguishing part 330 can be an opening with other shapes, such as square, triangle and the like. It can also be a recess that does not penetrate the cartridge shell 220, and the distinguishing part 330 is more obvious by filling the recess with pigment. The distinguishing part 330 can also be arranged at other positions, such as a recess on the base 260.

Figure 13:
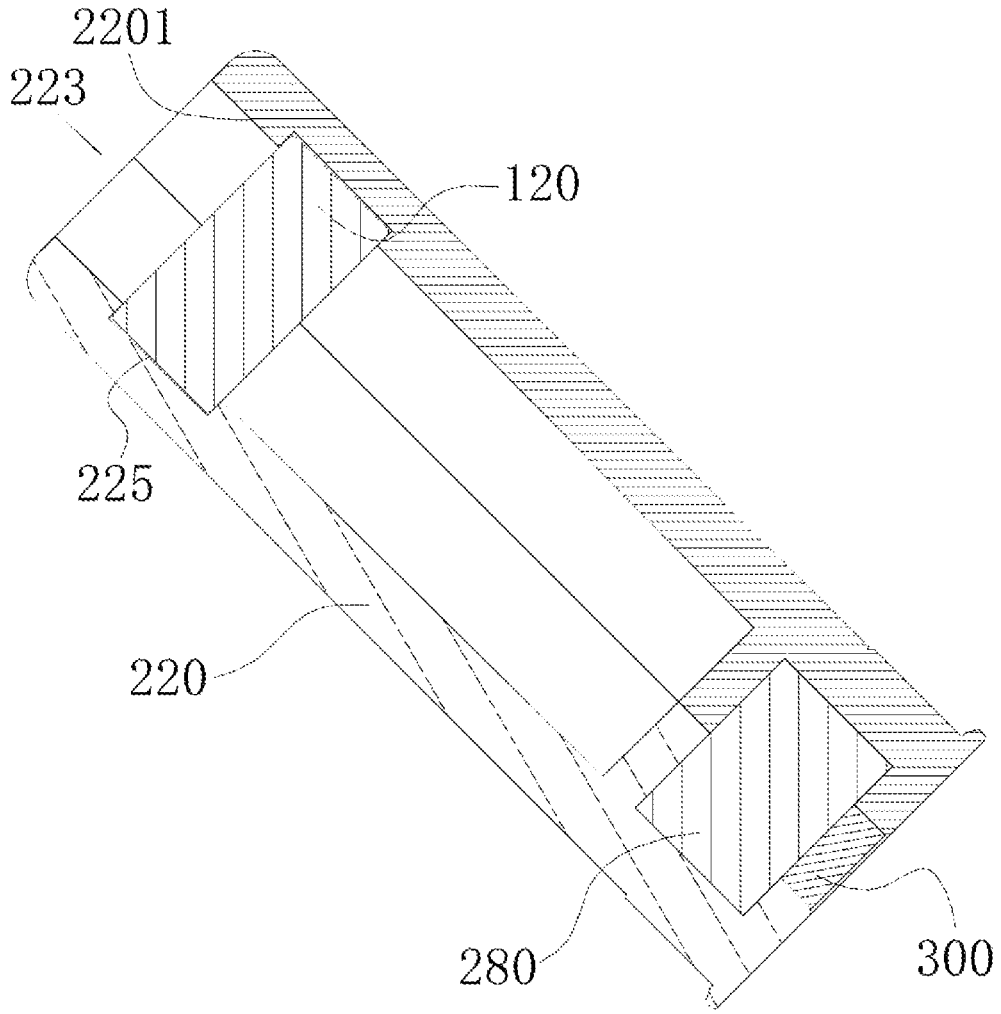
FIG. 13 is a sectional view taken along the longitudinal axis in the ninth embodiment of the dummy ammo.

As shown in FIG. 13, this is the ninth embodiment of a dummy ammo, which includes a counterweight block 120, two cartridge shells 220 and a base counterweight 280. The two cartridge shells 220 are assembled by ultrasonic welding. Before assembling, the counterweight block 120 and the base counterweight 280 are put into the cartridge shells 220.

Figure 14:
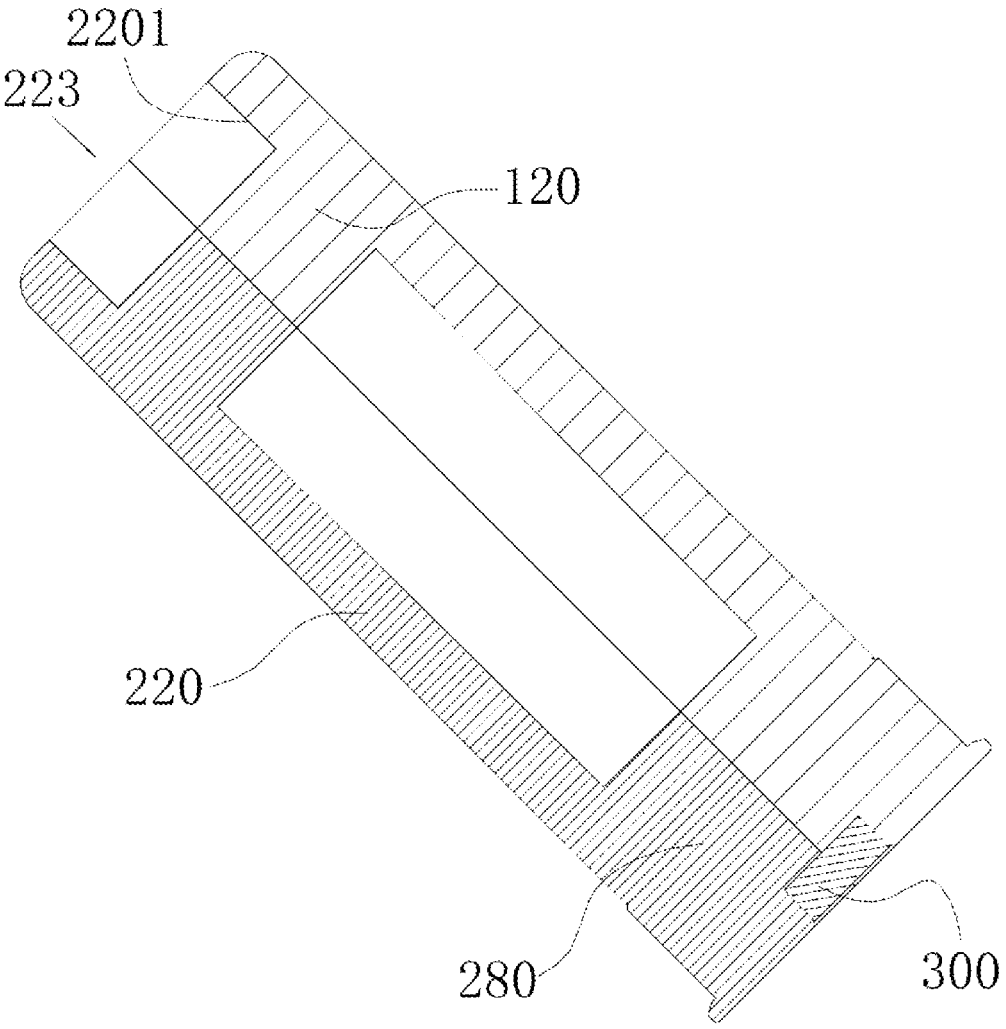
FIG. 14 is a cross-sectional view taken along the longitudinal axis in the tenth embodiment of the dummy ammo.

As shown in FIG. 14, this is the tenth embodiment of a dummy ammo, which includes two cartridge casings 220, which are assembled by ultrasonic welding. The cartridge casings 220 are provided with protrusions at the position close to the counterweight opening 223 and at the other end far from the counterweight opening 223. After assembling, a hollow cavity is formed in the middle of the cartridge casings 220, so the weight distribution of ammunition is still close to that of live ammo.

In other embodiments, the hollow cavity is filled with other materials with lower density than the cartridge shell 220, and there is no hollow cavity, but the weight distribution of ammunition is still close to that of live ammo.

The present invention has been described by preferred embodiments, and those skilled in the art will know that various changes and equivalent substitutions can be made to these features and embodiments without departing from the spirit and scope of the present invention. The present invention is not limited by the specific embodiments disclosed here, and other embodiments that fall within the claims of this application are within the scope of protection of the present invention.

What is claimed is:

1. A dummy ammo, comprising at least one counterweight component and at least one contour component, wherein said contour component has at least one longitudinal axis, and said contour component defines at least one front end and at least one rear end; and said contour component comprises at least one cartridge shell, and said counterweight component comprises at least one counterweight block, wherein said cartridge shell is provided with at least one inner wall; said inner wall defines at least one cavity, and said counterweight block is fixed in said cavity, and said cartridge shell is provided with at least one counterweight opening, and said counterweight opening is closer to said front end than said rear end; and when said counterweight component is fixed, a center of gravity of said counterweight component is closer to said counterweight opening than the counterweight component is to said rear end in a direction parallel to said longitudinal axis;

wherein said contour component further comprises at least one base, said base is closer to said rear end than said front end; and said cartridge shell is connected with said base;

wherein said cartridge shell is detachably connected with said base, and said counterweight component further comprises at least one connector, and said base is provided with at least one joint cavity, and said connector is connected with said base through said joint cavity;

wherein the dummy ammo further comprises at least one basic positioning part, which is arranged on said inner wall and protrudes from said inner wall; and wherein the at least one basic positioning part engages a rear face of the counterweight.

2. The dummy ammo according to claim 1, wherein said contour component has a same external contour as a live ammunition, and, the whole counterweight block is completely fixed in said cavity, and a density of said counterweight block is different from that of said cartridge shell.

3. The dummy ammo according to claim 1, wherein said counterweight block is provided with at least one counterweight connecting part, which covers at least a part of said connector, and said counterweight block is movably arranged on the connector.

4. The dummy ammo according to claim 1, further comprising at least one pressing block, which is arranged at the counterweight opening, and ends of said counterweight block are respectively contacted with the pressing block and the contour component.

5. The dummy ammo according to claim 1, further comprising at least one bushing which is arranged between the counterweight block and the base, at least part of said connector is covered by said bushing, and ends of said bushing contact the counterweight block and the contour component respectively.

6. The dummy ammo according to claim 1, further comprising at least one reinforced positioning part which protrudes from said basic positioning part.

7. The dummy ammo as claimed in claim 1, wherein one end of said cartridge shell far from said counterweight opening is provided with at least one cartridge shell receiving part, and said cartridge shell receiving part is provided with at least one cartridge shell receiving cavity.

8. The dummy ammo according to claim 7, wherein said base defines at least one top surface and at least one bottom surface opposite to said top surface; a joint part is set on said top surface, and comprises at least one receiving sidewall which has protrudes away from said bottom surface; the joint part further comprises at least one joint cavity, and said receiving sidewall covers at least a part of said joint cavity; and wherein, when said cartridge shell is connected with said base, said cartridge shell receiving part contacts said top surface, and said cartridge shell receiving cavity covers at least part of said receiving sidewall.

9. The dummy ammo according to claim 1, wherein at least one primer cavity is arranged at said rear end of said contour component, and at least one shock absorber is arranged in said primer cavity, and said shock absorber contains at least a part of a shock absorbing material.

10. The dummy ammo according to claim 1, wherein said contour component is provided with at least one baffle ring near said rear end, and said baffle ring has an outer diameter larger than said cartridge shell.

11. The dummy ammo according to claim 1, wherein said counterweight block is fixed in said cartridge shell by insert injection molding.

12. The dummy ammo according to claim 2, wherein said cartridge shell is made of a material with a hardness lower than that of said base, and said base is made of a metal material.

13. The dummy ammo according to claim 1, wherein said counterweight block is fixed in said cartridge shell by ultrasonic fixing.

14. The dummy ammo according to claim 1, further comprising at least one distinguishing part which is arranged on said contour component and used for distinguishing a dummy ammo from a live ammo.

15. The dummy ammo according to claim 14, wherein said distinguishing part comprises at least one distinguishing hole, and said distinguishing hole is arranged on said cartridge shell.

16. The dummy ammo according to claim 1, wherein said contour component is made of a metal material.

17. A method for assembling a dummy ammo, comprising:

providing at least one connector, at least one base, at least one counterweight block and at least one cartridge shell, wherein said cartridge shell is provided with at least one inner wall which defines at least one cavity, said cartridge shell is provided with at least one counterweight opening, and said base is provided with at least one joint cavity, and said counterweight block has a density different from that of said cartridge shell; and connecting said connector with said counterweight block;

putting said counterweight block into said cavity from said counterweight opening;

connecting said cartridge shell with said base such that said cartridge shell is detachably connected with said base;

allowing said connector to be fixedly connected with said base through said joint cavity; and arranging at least one basic positioning part on said inner wall such that the at least one basic positioning part protrudes from said inner wall and engages a rear face of the counterweight.

* * * * *